US009714504B2

(12) United States Patent
Bird et al.

(10) Patent No.: US 9,714,504 B2
(45) Date of Patent: Jul. 25, 2017

(54) BATHTUB DRAIN AND OVERFLOW KIT

(71) Applicant: Canplas Industries Ltd., Barrie (CA)

(72) Inventors: Andrew Bird, Shanty Bay (CA); Scott Baldwin, Barrie (CA); Pauline Siu, Barrie (CA)

(73) Assignee: CANPLAS INDUSTRIES LTD., Ontario (CA)

( * ) Notice: Subject to any disclaimer, the term of this patent is extended or adjusted under 35 U.S.C. 154(b) by 579 days.

(21) Appl. No.: 14/137,106

(22) Filed: Dec. 20, 2013

(65) Prior Publication Data

US 2015/0089736 A1 Apr. 2, 2015

(30) Foreign Application Priority Data

Oct. 2, 2013 (CA) ..... 2829072

(51) Int. Cl.
*E03C 1/22* (2006.01)
*E03C 1/24* (2006.01)

(52) U.S. Cl.
CPC . *E03C 1/22* (2013.01); *E03C 1/24* (2013.01)

(58) Field of Classification Search
CPC ..... E03C 1/22; E03C 1/24; E03C 2001/2413; B25B 13/02; B25B 13/84
USPC ..... 4/679–683, 686, 694, 695; 138/90; 81/176.15
See application file for complete search history.

(56) References Cited

U.S. PATENT DOCUMENTS

| | | | | |
|---|---|---|---|---|
| 1,467,936 | A * | 9/1923 | Janssen | B25B 13/48 81/176.15 |
| 1,883,609 | A | 10/1932 | Dennis | |
| 2,477,478 | A | 7/1949 | Donahue | |
| 2,556,659 | A | 6/1951 | Patterson | |
| 2,599,767 | A | 6/1952 | Long | |
| 2,605,664 | A * | 8/1952 | Galbraith | B25B 13/48 81/129 |
| 2,880,425 | A | 4/1959 | Lengyel | |
| 2,886,829 | A * | 5/1959 | Kadish | E03C 1/22 277/606 |
| 3,123,367 | A | 3/1964 | Brummer | |
| 3,334,774 | A | 8/1967 | Poltorak | |
| 3,355,181 | A | 11/1967 | Olson | |
| 3,490,776 | A | 1/1970 | Avery | |
| 3,680,153 | A | 8/1972 | Haldopoulos et al. | |

(Continued)

FOREIGN PATENT DOCUMENTS

CA 2338814 C 8/2002

*Primary Examiner* — Erin Deery
(74) *Attorney, Agent, or Firm* — Hoffmann & Baron, LLP

(57) ABSTRACT

A bathtub drain and overflow fitting kit is provided having a drain fitting, an overflow fitting and/or an adapter fitting, for connecting the bathtub drain and overflow openings to the household waste plumbing. The overflow fitting has a ball and socket connection between its inlet and outlet. Preferably, the overflow fitting has an abutment member which limits the range of angles created by the joint socket and joint ball within a range of angles to about 10°. The kit includes a gasket having a first sealing portion, a second sealing portion, and a tapered sealing portion between the first and second sealing portions, and is configured so that the same gasket may be used at the drain opening or the overflow opening. The drain and overflow fittings have at their inlets retaining features that interengage matching retaining features on the gasket to hold during installation.

11 Claims, 16 Drawing Sheets

(56) References Cited

U.S. PATENT DOCUMENTS 3,695,646 A 10/1972 Mommsen
3,701,452 A 10/1972 Tonn
3,712,645 A 1/1973 Herter
3,931,992 A 1/1976 Coel
3,997,197 A 12/1976 Marsh et al.
4,077,656 A 3/1978 Swindler
4,125,913 A * 11/1978 Lewis ..... B25B 13/48 7/138
4,298,219 A 11/1981 Amelink
4,418,922 A 12/1983 Janzito
4,560,174 A 12/1985 Bisi
4,683,597 A * 8/1987 Taylor, Jr. ..... A47K 1/14 138/89
4,778,189 A 10/1988 Udagawa
4,834,395 A 5/1989 Benford
5,090,276 A * 2/1992 Groskey ..... B25B 13/48 81/176.15
5,103,698 A * 4/1992 Delaney ..... B25B 13/48 81/13
5,199,331 A * 4/1993 Tsukamoto ..... B25B 13/48 81/121.1
5,390,939 A 2/1995 Terauchi et al.
5,507,501 A * 4/1996 Palmer ..... E03F 7/02 137/68.11
5,626,520 A 5/1997 Mazziotti
5,946,990 A * 9/1999 Bonacci ..... B23D 49/003 30/103
6,049,921 A * 4/2000 Erbs ..... E03C 1/22 4/650
6,056,329 A * 5/2000 Kitani ..... F16L 27/026 285/145.3
6,058,525 A 5/2000 Paden
6,212,709 B1 * 4/2001 Newton ..... B25B 13/02 4/613
6,295,664 B2 10/2001 Fritz et al.
6,415,463 B1 7/2002 Slothower
6,484,331 B2 11/2002 Minnick
6,681,420 B1 1/2004 Ball
6,687,926 B1 2/2004 Bayley
6,691,411 B2 * 2/2004 Ball ..... B25B 13/48 29/890.141
6,698,317 B1 * 3/2004 Machovsky ..... B25B 13/02 81/124.2
6,845,528 B2 * 1/2005 Bantz ..... E03C 1/24 4/295
6,859,956 B2 3/2005 Mantyla et al.
6,886,193 B2 5/2005 McAlpine
7,121,556 B2 10/2006 Barth et al.
7,197,777 B2 4/2007 Ismert et al.
7,237,280 B1 7/2007 Holden, Jr. et al.
7,650,651 B2 * 1/2010 Lohnert ..... A47K 1/14 4/295
7,866,670 B2 1/2011 Dhole et al.
7,963,197 B2 * 6/2011 Starko ..... B25B 23/0085 81/176.15
2002/0032926 A1 3/2002 Lewis
2002/0112285 A1 * 8/2002 Minnick ..... E03C 1/24 4/694
2003/0126676 A1 7/2003 Gallacher et al.
2004/0117907 A1 6/2004 Ball
2008/0155745 A1 7/2008 Burr
2008/0216229 A1 9/2008 Johannes
2009/0249542 A1 10/2009 Uhl
2009/0260154 A1 10/2009 Shoop et al.
2010/0163131 A1 * 7/2010 Fehr ..... F16L 55/1108 138/89

* cited by examiner

BATHTUB DRAIN AND OVERFLOW KIT

FIELD OF THE INVENTION

The present invention relates generally to bathtub drain and overflow assemblies.

BACKGROUND OF THE INVENTION

Modern bathtubs have a drain opening and an overflow opening. The drain opening is positioned at the lowest point in a bathtub bottom wall, and allows water to be drained from the bathtub when it is no longer needed. The overflow opening is positioned in a bathtub end wall, usually below the taps, and allows for excess water to drain from the bathtub when it is overfilled. While drain openings often are set in the bathtub bottom walls so as to be level with the ground, overflow openings are often set in line with the slope of the bathtub end walls, which often extend upwardly from the bathtub bottom walls at a non-vertical angle.

Drain and overflow openings are typically connected to household waste plumbing with drain and overflow fittings, which attach sealingly to the respective drain and overflow openings, and conduits which connect the drain and overflow fittings to the household waste water plumbing. Recently innovative manufacturers have provided the drain fittings, overflow fittings, and conduits together and sold them as a kit, along with other plumbing fittings and trim fittings, such as for example faceplates and drain baskets.

There have been numerous attempts at overcoming problems associated with prior art bathtub drain and overflow kits.

Bathtubs come in a variety of designs. The relative positions of drain and overflow openings often vary from bathtub to bathtub. Similarly, the slope of bathtub end walls varies from bathtub to bathtub as does the size of the overflow openings. Both the slope of the bathtub end wall and the location of the overflow opening create challenges for the creation of bathtub drain and overflow kits that can be used on more than one bathtub design. The various differences in bathtub designs has therefore required manufacturers to make bathtub overflow kits specific to the several different bathtub designs, which is burdensome for resellers who need to stock several different kits. Furthermore, if fixed fittings are used between the overflow opening and the drain, then stress will be added to the system, particularly if force is required to connect the fittings between the drain and overflow opening. Often fittings will be connected together permanently using solvent cement.

U.S. Pat. No. 6,886,193 (McAlpine) discloses one attempt at overcoming the problem of the relative alignment of the overflow and the drain. McAlpine discloses an overflow head which is connected to a down pipe by a ball and socket joint. The ball and socket joint in McAlpine allows for relative alignment of the overflow head and the outlet. However, McAlpine teaches fixing the ball and socket joint to retain its position after the installation. A problem with the McAlpine overflow head is that it requires a cumbersome brass circular nut to secure the joint together. The preferred form of the McAlpine bath waste is said to have the nut fixed or "factory sealed" onto the joint, using glue or welding, to prevent users from disassembling the joint. The tightness of the fixed nut is sufficient to permit a degree of movement of the ball and socket joint, to allow the relative alignment of the head and outlet to be adjusted. However, a failure to properly tighten the brass circular nut can cause problems. For example, if the brass nut is not sufficiently tightened, the joint may leak. On the other hand if the brass nut is overtightened the joint may become a fixed joint, which is undesirable because it can add stress to the system. The use of welding or glue can also cause the joint to become a fixed joint. The McAlpine bath waste is also susceptible to leaking from the joint loosening over time from repetitive expansions and contractions of the joint and the pipes connected to it, in response to cycles of hot bath water draining through the system.

Furthermore, it is common for municipal plumbing codes to require plumbing joints that are located in an inaccessible location, such as inside a wall or floor, to be permanent. This means that a detachable connection between the drain and overflow openings is not permitted by most municipal plumbing codes since it is not a permanent connection.

Another problem with the variability of bathtub designs is that the variability in bathtub end wall slopes creates challenges for properly aligning and installing the sealing gaskets at the overflow openings. The problem of properly installing overflow gaskets also arises in those cases where different bathtubs have different sizes of overflow openings. Prior bathtub drain and overflow kits often have overflow gaskets that are difficult to fix into place during assembly of the overflow fitting. The prior art gaskets are often disc-shaped washer-type seals that are held in place through pressure, which means that misalignment can occur easily. Proper sealing of the overflow gasket often requires the gasket to be properly centered with respect to the overflow opening. Misalignment of the gasket at the overflow opening will result in a leaking connection.

Another problem with prior art bathtub drain and overflow fittings is that different gasket designs are required depending on whether it is used for a drain opening or an overflow opening. This problem arises because the openings in the bathtub walls are generally different sizes for the drain and the overflow. For example, U.S. Pat. No. 2,880,425 (Lengyel) discloses a drain apparatus which has an interposed sealing gasket for sealing the overflow opening. The sealing gasket is shown having a slanted portion which seals against the bath tub. However, Lengyel discloses two separate gaskets for the overflow opening and the drain opening. This means that separate seals must be specifically designed for each of the openings. Furthermore, if replacement parts are required, for example, if a gasket is lost or damaged, a different gasket part would be required depending on whether the replacement part is to be connected to the overflow opening or the drain opening. Moreover, this means that if a drain and overflow kit is sold with replacement pieces, different replacement gaskets would be required for each of the drain and overflow openings, adding to the complexity of the system.

Other prior art patents of general interest in the field of plumbing connections and fittings include:

Canadian Patent No. 2,338,814 (Marsden et al.);

U.S. Pat. No. 1,883,609 (Dennis), U.S. Pat. No. 2,477,478 (Donahue), U.S. Pat. No. 2,556,659 (Patterson), U.S. Pat. No. 2,599,767 (Long), U.S. Pat. No. 3,123,367 (Brummer et al.), U.S. Pat. No. 3,334,774 (Poltorak), U.S. Pat. No. 3,355,181 (Olson), U.S. Pat. No. 3,490,776 (Avery), U.S. Pat. No. 3,680,153 (Haldopoulos et al.), U.S. Pat. No. 3,695,646 (Mommsen), U.S. Pat. No. 3,701,452 (Tonn), U.S. Pat. No. 3,712,645 (Herter), U.S. Pat. No. 3,931,992 (Coel), U.S. Pat. No. 3,997,197 (Marsh et al.), U.S. Pat. No. 4,077,656 (Swindler), U.S. Pat. No. 4,298,219 (Amelink), U.S. Pat. No. 4,418,922 (Janzito), U.S. Pat. No. 4,560,174 (Bisi), U.S. Pat. No. 4,778,189 (Udagawa), U.S. Pat. No. 4,834,395 (Benford), U.S. Pat. No. 5,390,939 (Terauchi et al.), U.S. Pat. No. 5,626,520 (Mazziotti), U.S. Pat. No. 6,058,525 (Paden), U.S. Pat. No. 6,295,664 (Fritz et al.), U.S. Pat. No. 6,415,463 (Slothower), U.S. Pat. No. 6,484,331 (Minnick), U.S. Pat. No. 6,681,420 (Ball), U.S. Pat. No. 6,687,926 (Bayley), U.S. Pat. No. 6,859,956 (Mantyla et al.), U.S. Pat. No. 7,121,556 (Barth et al.), U.S. Pat. No. 7,197,777 (Ismert et al.), U.S. Pat. No. 7,237,280 (Holden, Jr. et al.), and U.S. Pat. No. 7,866,670 (Dhole et al.); and U.S. Patent Application Publication Nos. 2002/0032926 (Lewis), 2003/0126676 (Gallacher et al.), 2004/0117907 (Ball), 2008/0155745 (Burr), 2008/0216229 (Johannes), 2009/0249542 (Uhl), 2009/0260154 (Shoop et al.).

Therefore there is a continuing need for improvement in the design of bathtub drain and overflow fitting kits.

SUMMARY OF THE INVENTION

The present invention is directed to improved drain fittings, overflow fittings, an adapter fitting, and a gasket, for a bathtub drain and overflow kit, which overcome at least some of the problems associated with the prior art.

According to preferred embodiments of the present invention the drain, overflow, and adapter fittings are configured to retain the gasket at their inlets. Accordingly, the preferred fittings have at their inlets a flange which includes a retaining feature for interengaging with matching retaining features on the gasket to retain the gasket thereon. The flange is also sized and shape to seal to a sealing side of the gasket around the bathtub drain or overflow openings.

Preferably, the drain and overflow fittings are adjustable in angle relative to each other to accommodate for variations in the slopes of bathtub end walls. Accordingly, the drain and overflow fittings have a joint ball and joint socket and a snap ring to permanently join the joint ball and the joint socket to form a leak resistant joint that permits a range of angles between the inlet and outlet of the fitting to facilitate ease of installation.

According to one embodiment of the present invention, the range of angles between the joint ball and joint socket is limited to ensure the joint ball and joint socket will not pass beyond a range of angles in which the joint can operate in a leakproof manner. For example the adjustable fitting can include an abutment member extending from an outer surface of the joint ball and positioned to engage an edge of the joint socket at a predetermined angle which limits the range of angles created by the joint socket and joint ball within a range of angles of about 10°.

The preferred gasket can be used at either the drain opening or the overflow opening of a bathtub. Accordingly, the preferred gasket has a first sealing portion, a second sealing portion and a tapered sealing portion between the first and second sealing portions. The first sealing portion is sized and positioned to seal against a bottom wall of the bathtub around a drain opening in the bottom wall of the bathtub. The tapered sealing portion is sized and positioned to wedge into an overflow opening formed in the bathtub end wall to form a primary seal. The second sealing portion is sized and positioned to seal against a bathtub end wall around the overflow opening to form a secondary seal.

Therefore, according to one aspect of the present invention, there is provided a gasket for a bathtub drain and overflow kit, said gasket having a sealing side, said gasket comprising:

an aperture positioned substantially through a centre of said gasket, said aperture being sized and shaped to accommodate a drain basket or a faceplate retainer;

a first sealing portion extending around said aperture on said sealing side, said first sealing portion being sized and positioned on said gasket to seal against a bottom wall of said bathtub around a drain opening formed in said bottom wall of said bathtub;

a second sealing portion extending around said first sealing portion on said sealing side, said first sealing portion being raised relative to said second sealing portion, said second sealing portion being sized and positioned to seal against a bathtub end wall around an overflow opening to form a secondary seal around said overflow opening; and a tapered sealing portion extending between said first sealing portion and said second sealing portion, said tapered sealing portion being sized and positioned to wedge into said overflow opening formed in said bathtub end wall to form a primary seal;

wherein the same gasket can be used at either said drain opening or said overflow opening.

According to another aspect of the present invention, there is provided a fitting for a bathtub drain and overflow kit, said fitting having an inlet comprising:

a flange sized and shaped to seal a sealing side of a gasket around a bathtub drain opening or a bathtub overflow opening, said gasket having a retaining feature on the opposite side of said gasket from said sealing side; and a matching retaining feature formed on said flange;

wherein said retaining feature and said matching retaining feature interengage to retain said gasket on said flange.

According to yet another aspect of the present invention, there is provided an adjustable bathtub drain or overflow fitting for a bathtub drain and overflow kit, said adjustable bathtub drain or overflow fitting comprising:

an inlet body defining an inlet at one end and one of a joint socket and a joint ball at the other end, said joint socket having a part spherical inner surface, said joint ball having a part spherical outer surface that is sized and shaped to mate with said joint socket;

an outlet body defining an outlet at one end and the other of said joint socket and said joint ball at the other end;

a seal member positioned between said outer surface of said joint ball and said inner surface of said joint socket; and a snap ring configured to permanently join said joint ball and said seal member to said joint socket to form a leak resistant joint, said snap ring having one or more locking features configured to interengage with one or more corresponding locking features on an outer surface of said joint socket; and a passageway between said inlet and said outlet;

wherein said fitting permits a range of angles between said inlet and said outlet to facilitate ease of installation.

According to yet another aspect of the present invention, there is provided an adjustable bathtub drain or overflow fitting for a bathtub drain and overflow kit, said adjustable bathtub drain or overflow fitting comprising:

an inlet body defining an inlet at one end and one of a joint socket and a joint ball at the other end, said joint socket having a part spherical inner surface, said joint ball having a part spherical outer surface that is sized and shaped to mate with said joint socket;

an outlet body defining an outlet at one end and the other of said joint ball and said joint socket at the other end;

a seal member positioned between said outer surface of said joint ball and said inner surface of said joint socket; and said joint socket and said joint ball being sized an shaped to permit said joint socket and said joint ball to be snapped together to form a leak resistant joint over a range of angles;

a passageway between said inlet and said outlet; and an abutment member extending from said outer surface of said joint ball, and positioned to engage an edge of said joint socket at a predetermined angle of said inlet body relative to said outlet body;

wherein said abutment member and said edge limit said range of angles to about 10°.

BRIEF DESCRIPTION OF THE DRAWINGS

Reference will now be made to the preferred embodiments of the present invention with reference, by way of example only, to the following drawings in which.

DETAILED DESCRIPTION OF THE PREFERRED EMBODIMENTS

The present invention is described in more detail with reference to exemplary embodiments thereof as shown in the appended drawing. While the present invention is described below including preferred embodiments, it should be understood that the present invention is not limited thereto. Those of ordinary skill in the art having access to the teachings herein will recognize additional implementations, modifications, and embodiments which are within the scope of the present invention as disclosed and claimed herein. For the purposes of clarity, not every component is labelled in every figure, nor is every component of each embodiment of the invention shown where illustration is not necessary to allow those of ordinary skill in the art to understand the invention.

Figure 1:
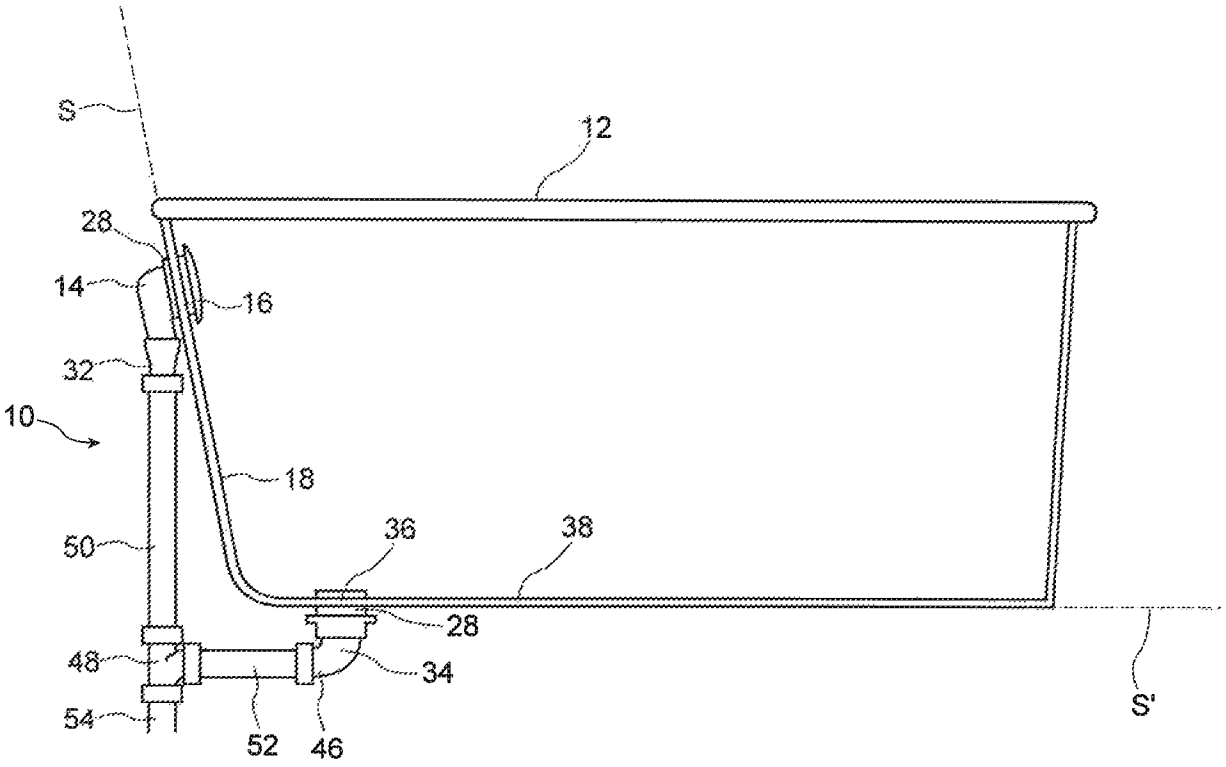
FIG. 1 is a diagram of a bathtub drain and overflow kit installed on a bathtub according to an embodiment of the present invention.

A bathtub drain and overflow kit 10 according to an embodiment of the present invention is shown in FIG. 1 installed on a bathtub 12. A bathtub overflow fitting 14 is attached at the overflow opening 16 in the bathtub end wall 18 with a threaded portion 20 of a faceplate retainer 22 passing through the overflow opening 16 into threaded engagement with a threaded portion 24 in the inlet 26 of the overflow fitting 14. A gasket 28 is attached to the inlet 26 of the overflow fitting 14 such that the gasket 28 is compressed between the overflow fitting 14 and the outside surface of the bathtub end wall 18 when the faceplate retainer 22 is secured to the overflow fitting 14, thus forming a watertight seal around the overflow opening 16. As will be discussed in more detail below, the faceplate retainer 22 has an unobstructed inlet, and passageway therethrough, and a faceplate 30 is preferably attached to the faceplate retainer 22 by interference fit coupling. As will be discussed in more detail below, the preferred overflow fitting 14 includes a ball and socket coupling or joint between its inlet 26 and its outlet 32, to accommodate bathtub end walls 18 with varying slopes S and to decrease stress in the system.

A bathtub drain fitting 34 is attached at the drain opening 36 in the bathtub bottom wall 38 with a threaded portion 40 of a drain basket 42 passing through the drain opening 36 into threaded engagement with a threaded portion 43 in the inlet 44 of the drain fitting 34. A gasket 28 is attached to the inlet 44 of the drain fitting 34 such that the gasket 28 is compressed between the drain fitting 34 and the outside surface of the bathtub bottom wall 38 when the drain basket 42 is secured to the drain fitting 34, thus forming a watertight seal. As will be discussed in more detail below, the gasket 28 installed at the overflow opening 16 is preferably identical to the gasket 28 installed at the drain opening 36. Although not shown, the drain fitting 14 may also be provided with a ball and socket joint between its inlet 44 and its outlet 46, to accommodate for variations in how the fitting may be connected, including the slope S' of the bathtub bottom wall, the slope S of the bathtub end wall or the installation of the fitting around other pipes or studs around the bathtub.

Preferably, the outlets 32, 46 of the overflow fitting 14 and the drain fitting 34 are sized and shaped to attach to standard plumbing fittings, such as for example pipes, elbows, T-connectors, Y-connectors, and the like. As shown in FIG. 1, the overflow fitting 14 and drain fitting 34 connect to a T-connector 48 via conduits 50, 52, which in turn connects to a waste conduit 54 connected to the household waste plumbing.

As will be appreciated, with the exception of the gasket 28, the other components of the bathtub drain and overflow kit will preferably be formed from plastics such as, for example, PVC or ABS by injection moulding, and joined together by solvent bonding, adhesive bonding or the like. Preferably the ball and socket joint will be factory assembled and made permanent with a snap ring as discussed in more detail below. The gasket 28 will preferably be formed from rubber, plastic, re-grinded resin from pre-existing products, or other resilient material(s) having water-tight sealing qualities. It is important that the gasket that is made from a material that is flexible to ensure a proper seal. The gasket may be constructed by various means, such as for example, by injection moulding, re-grinding pre-existing materials, or using 3D printing. However, other materials, manufacturing methods, and joining methods, will be available to persons skilled in the art, and all such materials and methods are contemplated by the present invention.

Figure 2:
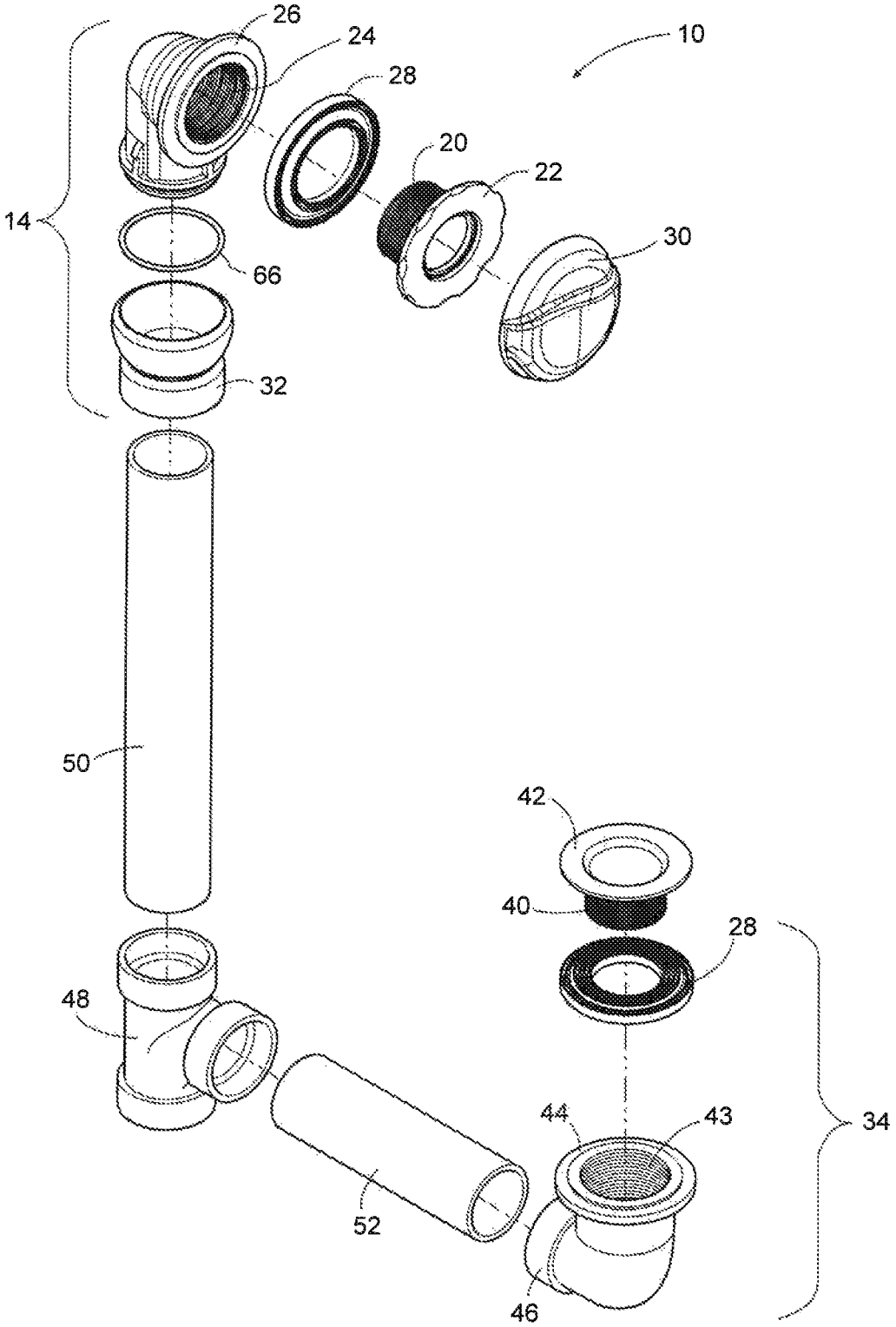
FIG. 2 is an exploded view of the bathtub drain and overflow kit of FIG. 1.

The components of the preferred bathtub drain and overflow kit 10 are best seen in the exploded view shown in FIG. 2. The bathtub 12 has been omitted from this view for added clarity.

Figure 3:
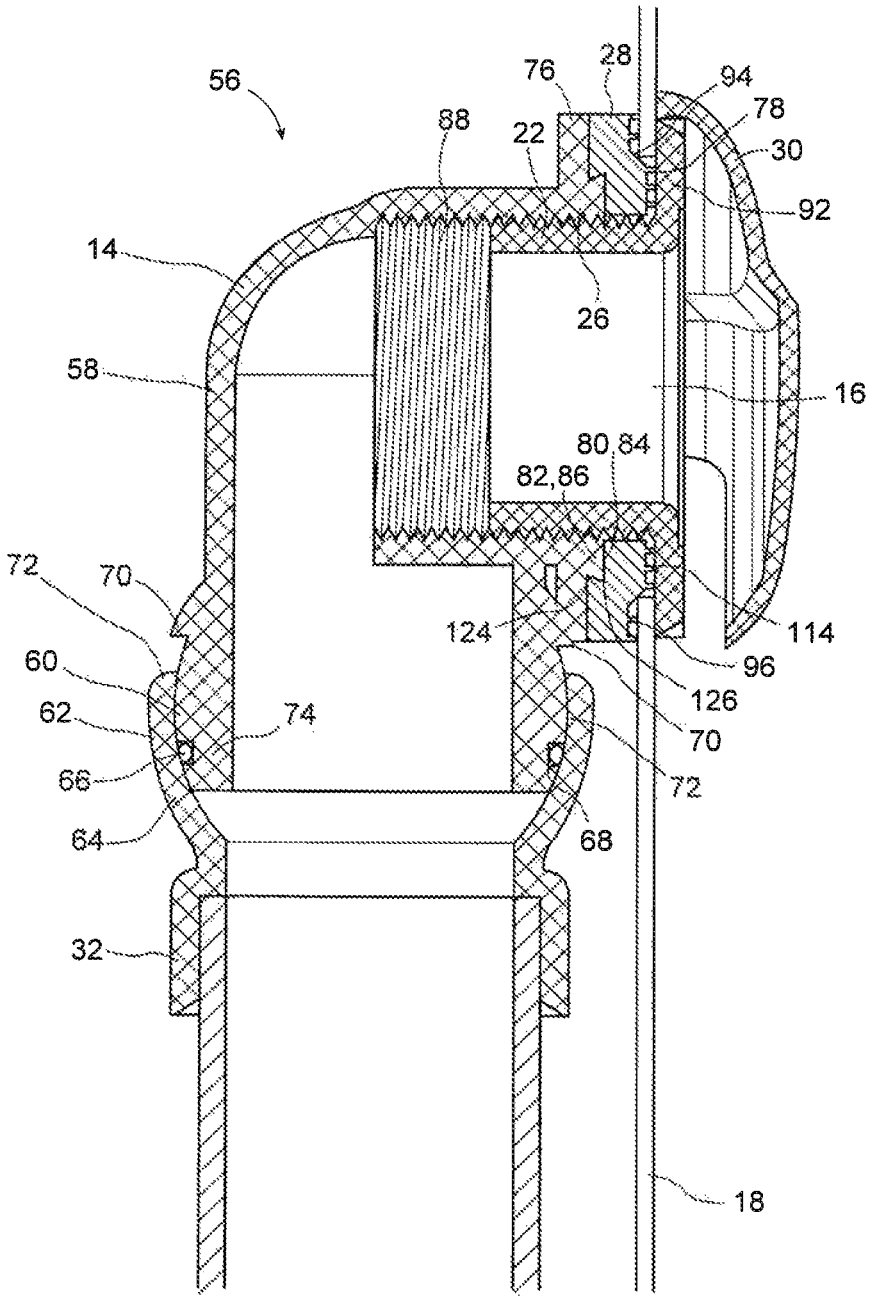
FIG. 3 is a cross-sectional view of the overflow portion of the bathtub drain and overflow kit of FIG. 1 installed at an overflow opening in the bathtub end wall, the overflow portion including a bathtub overflow fitting, a gasket, a faceplate retainer, and a faceplate.

Referring now to FIG. 3, there is shown a cross-section of the overflow portion 56 of the bathtub drain and overflow kit 10, according to an embodiment of the present invention, installed at the overflow opening 16 in the bathtub end wall 18. As can be seen, the overflow fitting 14 has an inlet body 58 defining an inlet 26 at one end and a joint ball 60 at the other end. The joint ball 60 has a part spherical outer surface. An outlet body 62 is snapped over the joint ball 60 to form a ball and socket joint. The outlet body 62 has the outlet 32 at one end and a joint socket 64 at the other end. The joint socket 64 has a part spherical inner surface that is sized and shaped to mate with the joint ball 60. A seal member 66 is positioned between the inner surface of the joint socket 64 and the outer surface of the joint ball 60 to permit the joint socket 64 and the joint ball 60 to form a leak resistant joint over a range of angles, with a passageway between the inlet 26 and the outlet 32 of the overflow fitting 14. The joint may provide a range of angles such as 6 to 7 degrees or as high as 10 degrees. The choice of the range of angles of the joint depend on the slope of the tub wall and the existence of other obstacles such as pipes or studs which might be in the way of fittings. Although a range of angles beyond 10 degrees are possible, it is important that the angle is not so large that the seal member 66 is exposed during use, which may cause damage to the seal member 66. The seal member 66 is preferably carried by a seal member retaining feature, such as for example a recess 68 in the outer surface of the joint ball 60. For example, the seal member 66 may be an o-ring and the seal member retaining feature may be a cutout in the surface which receives the o-ring. The o-ring is preferably formed from a single unitary piece.

Although, the embodiment of the overflow fitting 14 shown in FIG. 3 has the joint ball 60 on the inlet body 58, and the joint socket 64 on the outlet body 62, it will be appreciated that the invention comprehends the joint ball 60 being on the outlet body 62, and the joint socket 64 being on the inlet body 58. In other embodiments, the ball and socket joint may lie on different connections on the kit 10. For example, the outlet 46 and the conduit 52 may be joined by a ball and socket joint. It will be understood that a ball and socket joint could be used for any one of the connections within the bathtub drain and overflow kit 10. By having one ball and socket joint within the bathtub drain and overflow kit 10, there is a live joint in the system that reduces the stress between the connections and allows the kit to be connected around obstacles such as other pipes, studs or the like that might otherwise interfere with the installation of the fittings.

The joint ball 60 and joint socket 64 connection permits a range of angles in all directions between the inlet 26 and the outlet 32 which facilitates ease of installation and relieves stress by providing a live joint.

Preferably, an abutment member 70 is positioned on the joint ball 60, extending from the outer surface of the joint ball 60, to engage an edge 72 of the joint socket 64 at a predetermined angle of the inlet body 58 relative to the outlet body 62 of the overflow fitting 14. Preferably, the abutment member 70 and the edge 72 of the joint socket 64 interact to limit the range of angles to about 10°.

It will now be appreciated, that although the preferred overflow fitting 14 has an inlet body 58 with the inlet 26 at a 90° angle relative to its outlet 74, the attachment of an outlet body 62 to the outlet 74 of the inlet body 58 with a ball and socket joint permits a range of angles between the inlet 26 and the outlet 32 of the overflow fitting 14.

As mentioned above, the outlet 32 of the overflow fitting 14 is preferably attached to conduit 50, which in turn is attached to waste conduit 54 via T-connector 48, which also connects the drain fitting 34 via conduit 52.

The inlet 26 of the overflow fitting 14 is configure to carry gasket 28 and seal the inlet 26 to the overflow opening 16 of the bathtub end wall 18. Preferably, the inlet 26 includes a flange 76 sized and shaped to seal a sealing side 78 gasket 28 around the bathtub overflow opening 16. Preferably, the gasket 28 can be used at either the drain opening 36 or the overflow opening 16.

As discussed in more detail below, the gasket 28 preferably has a retaining feature 80 on the opposite side of the gasket from the sealing side 78. A matching retaining feature 82 is formed on the flange 76, and the retaining feature 80 and the matching retaining feature 82 interengage to retain the gasket 28 on the flange 76. Preferably, the retaining feature 80 is a substantially annular recessed portion 84, and the matching retaining feature 82 is a substantially annular raised portion 86 on the flange 76, and the interengagement is an interference fit coupling or the like. For example, the recessed portion 84 may include a continuous or discontinuous overhang 124 for engaging a matching lip or outwardly flared portion 126 of the raised portion 86 as shown in FIG. 3. This configuration makes installation easier as the user does not have to worry about the gasket 28 slipping or moving out of position when working with the overflow fitting 14.

As shown in FIG. 3, the inlet 26 includes a threaded portion 88 which is sized and configured to threadingly accept a faceplate retainer 22. It will now be understood that the overflow fitting 14 is secured to the overflow opening 16 by passing the threaded end 90 of the faceplate retainer 22 through the overflow opening 16 and threadingly securing it in the threaded portion 88 of the inlet 26 by turning the flanged end 92 of the faceplate retainer 22. The flanged end 92 of the faceplate retainer 22 is larger than the overflow opening 16 so that continued turning of the faceplate retainer draws the flange 76 of the inlet 26 towards the bathtub end wall 18, which presses the sealing side 78 of the gasket 28 against the bathtub end wall 18 around the overflow opening 16. As can be seen, a tapered sealing portion 94 of the gasket 28 is wedged into the overflow opening 16 to form a primary seal, while a second sealing portion 96 seals against the bathtub end wall 18 around the overflow opening 16 to form a secondary seal around the overflow opening 16. Preferably, the faceplate retainer 22 has an unobstructed inlet, and passageway therethrough, and a faceplate 30 is preferably attached to the faceplate retainer 22 by interference fit coupling. The faceplate 30 is preferably connected to the faceplate retainer 22 by a snap fit coupling, allowing the faceplate 30 to be snapped on and off of the faceplate retainer 22 without the use of tools. The faceplate 30 and the faceplate retainer 22 may be non-directional so that the faceplate 30 will allow overflow water to drain through the bathtub overflow regardless of the relative orientation of the faceplate 30 and faceplate retainer 22. As will now be appreciated, by configuring the faceplate retainer 30 to snap on and off of the faceplate retainer 22, obstructive cross bars and screw holders commonly used in the prior art can be omitted to provide an unobstructed inlet which permits access therethrough with for example a plumber's snake.

Figure 4:
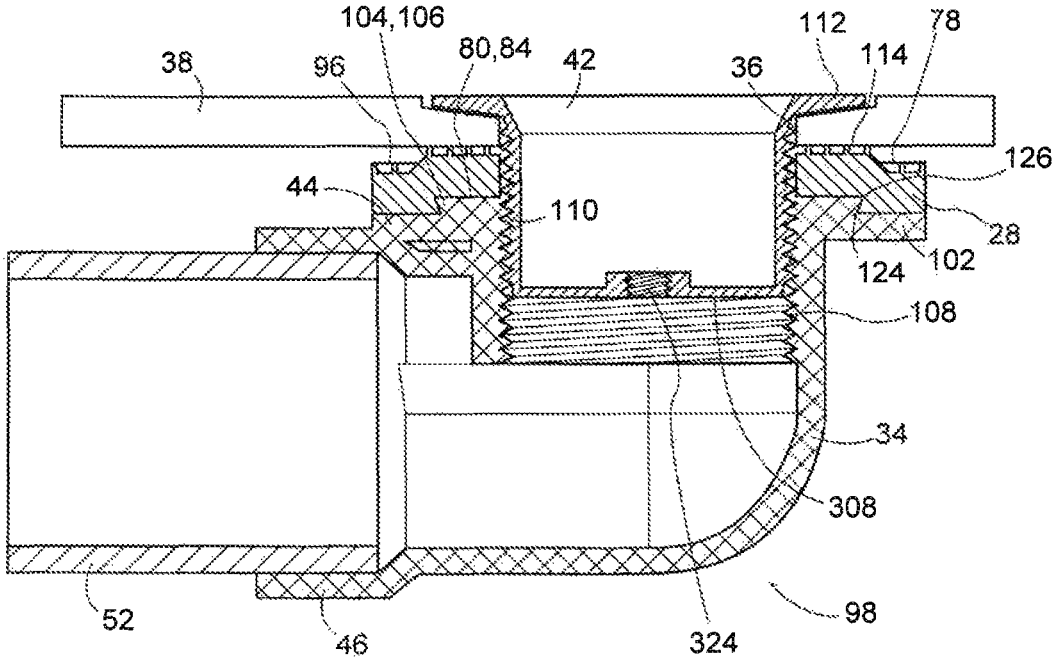
FIG. 4 is a cross-sectional view of the drain portion of the bathtub drain and overflow kit of FIG. 1 installed at a drain opening in the bathtub bottom wall, the drain portion including a bathtub drain fitting, a gasket, and a drain basket.

Referring now to FIG. 4, there is shown a cross-section of the drain portion 98 of the bathtub drain and overflow kit 10, according to an embodiment of the present invention, installed at the drain opening 36 in the bathtub bottom wall 38. As can be seen, the drain fitting 34 has an inlet 44 at one end and an outlet 46 at the other end. The outlet 46 of the drain fitting 34 is preferably attached to conduit 52, which in turn is attached to waste conduit 54 via T-connector 48, which also connects the overflow fitting 34 via conduit 50. Although not shown, the drain fitting 14 may also be provided with a ball and socket joint between its inlet 44 and its outlet 46, to accommodate bathtub bottom walls 38 with varying degrees of slopes S' and to release stress from the system by creating a live joint in the same way as discussed above in connection with the preferred overflow fitting 14.

The inlet 44 of the drain fitting 34 is configure to carry gasket 28 and seal the inlet 44 to the drain opening 36 of the bathtub bottom wall 38. Preferably, the inlet 44 includes a flange 102 sized and shaped to seal the sealing side 78 of gasket 28 around the bathtub drain opening 36. As mentioned above, preferably the gasket 28 can be used at either the drain opening 36 or said overflow opening 16.

As discussed above, the preferred gasket 28 has a retaining feature 80 on the opposite side of the gasket from the sealing side 78. A matching retaining feature 104 is formed on the flange 102, and the retaining feature 80 and the matching retaining feature 104 interengage to retain the gasket 28 on the flange 102. Preferably, the retaining feature 80 is a substantially annular recessed portion 84, and the matching retaining feature 104 is a substantially annular raised portion 106 on the flange 102, and the interengagement is an interference fit coupling or the like. For example, the recessed portion 84 may include a continuous or discontinuous overhang 124 for engaging a matching lip or outwardly flared portion 126 of the raised portion 106 as shown in FIG. 4. This configuration makes installation easier as the user does not have to worry about the gasket 28 slipping or moving out of position when working with the drain fitting 34.

As shown in FIG. 4, the inlet 44 includes a threaded portion 108 which is sized and configured to threadingly accept a drain basket 42. It will now be understood that the drain basket 42 is secured to the drain opening 36 by passing the threaded end 110 of the drain basket 42 through the drain opening 36 and threadingly securing it in the threaded portion 108 of the inlet 44 by turning the flanged end 112 of the drain basket 42, or by using a drain basket wrench, or a combination test plug and drain basket wrench tool 304 which is discussed in more detail below. The flanged end 112 of the drain basket 42 is larger than the drain opening 36 so that continued turning of the drain basket draws the flange 102 of the inlet 44 towards the bathtub bottom wall 38, which presses the sealing side 78 of the gasket 28 against the bathtub bottom wall 36 around the drain opening 36. As can be seen, a first sealing portion 114 of the gasket 28 seals against the bathtub bottom wall 38 around the drain opening 36 to form a primary seal around the drain opening 36.

Figure 5:
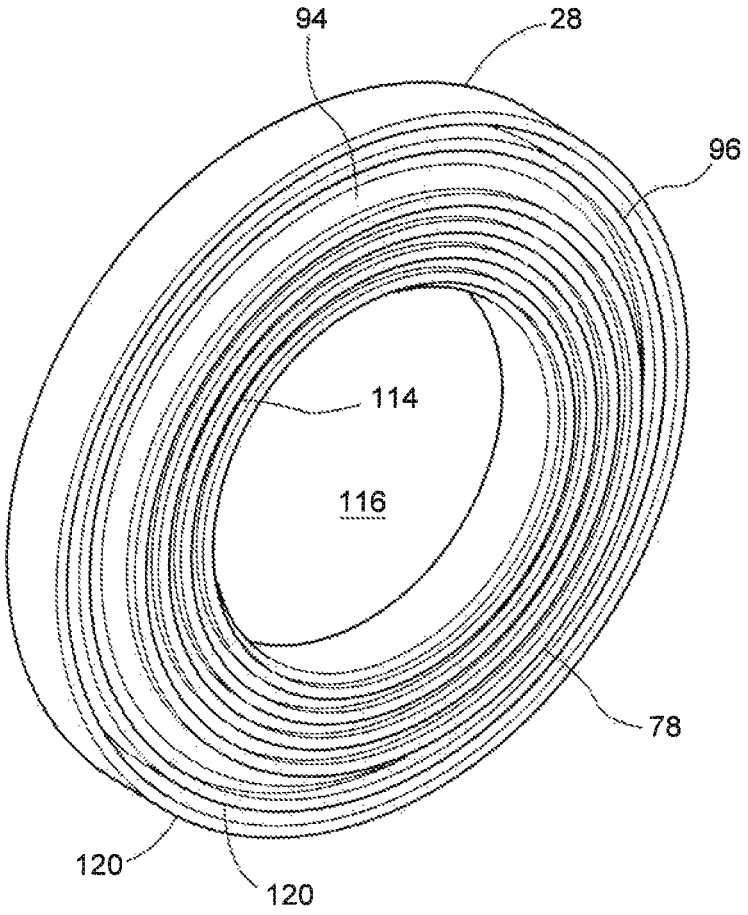
FIG. 5 is a perspective view of the gasket in the bathtub drain and overflow kit of FIG. 1.
Figure 6:
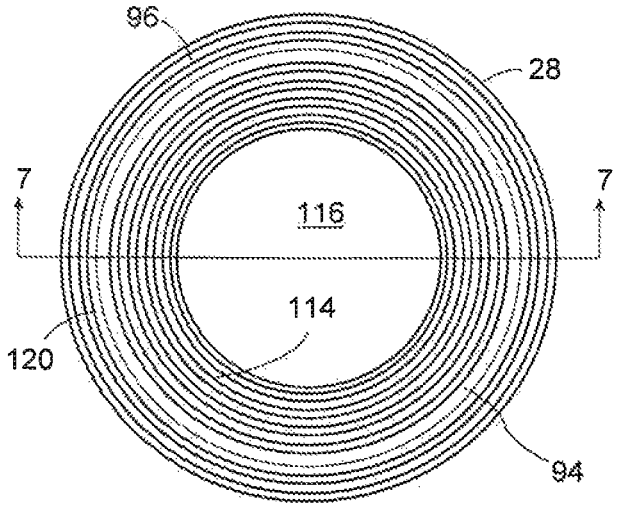
FIG. 6 is a plan view of the gasket of FIG. 5.
Figure 7:
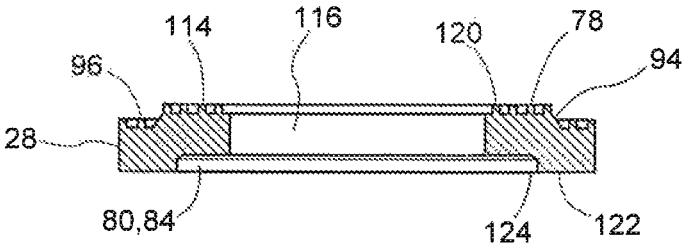
FIG. 7 is a cross-sectional view of the gasket of FIG. 6 taken along line 7-7.

Referring now to FIGS. 5 to 7, the gasket 28 will now be discussed in more detail. As can be seen, preferably the gasket 28 is annular in shape for use in circular drain and overflow openings 36, 16. It will be appreciated that the gasket 28 may be formed in other shapes to match the shapes of other drain and overflow openings. All such shapes are comprehended by the broad scope of the present invention. What is important is that the gasket 28 has an aperture 116, a first sealing portion 114, a second sealing portion 96, a tapered sealing portion 94 between the first and second sealing portions, and is configured so that the same gasket 28 can be used at either the drain opening 36 or the overflow opening 16.

As can be seen, the aperture 116 is positioned substantially through a centre of the gasket 28. Preferably the aperture 116 is sized and shaped to accommodate a drain basket 42 or a faceplate retainer 22. In this respect, good results have been obtained using a circular aperture having a diameter of 2.58 cm to 2.62 cm. The first sealing portion 114 extends around the aperture 116 on the sealing side 78 and is sized and positioned on the gasket 28 to seal against the bathtub bottom wall 38 around the drain opening 36 formed in the bathtub bottom wall 38. The preferred first sealing portion 114 is annular and has an outside diameter of 3.04 cm to 3.08 cm.

The second sealing portion 96 extends around the first sealing portion 114 on the sealing side 78, and is raised relative to the second sealing portion 96. Preferably, the first sealing portion 114 is raised from the second sealing portion 96. The second sealing portion 96 is sized and positioned to seal against the bathtub end wall 18 around the overflow opening 16 to form a secondary seal around the overflow opening 16. The preferred second sealing portion is annular. The second sealing portion may have an outside diameter that matches the diameter of the bathtub drain fitting 34 or the bathtub overflow fitting 14, although different outer diameters are possible. The tapered sealing portion 94 extends between the first sealing portion 114 and the second sealing portion 96. The tapered sealing portion 94 is sized and positioned to wedge into the overflow opening 16 formed in the bathtub end wall 18 to form a primary seal, as best seen in FIG. 3. Preferably, the tapered sealing portion 94 is configured to allow the gasket 28 to self-centre against the overflow opening 16 when the overflow fitting 14 is installed at the overflow opening 16 in the bathtub end wall 18. The first sealing portion 114 is also sized and positioned on said gasket 28 to seal against the faceplate retainer 22 at the overflow opening 16 when the gasket is installed against the overflow opening 16. The industry standard for the outside diameter of the overflow openings is generally between 3" to 3.25" and so the tapered sealing portion 94 should have a corresponding diameter so that the tapered sealing portion 94 will wedge into the overflow opening 16 when in position.

Preferably, the first sealing portion 114 and/or the second sealing portion 96 comprise one or more sealing features 120. The sealing features 120 are resilient ribs or ridges extending from the first and/or second sealing portions 114, 96 to assist in providing a watertight seal. However, sealing features 120 may be altogether omitted.

As best seen in FIG. 7, the opposite side 122 of the gasket 28 from the sealing side 78 preferably includes the retaining feature 80 for interengaging the matching retaining feature 82 on the inlet of the bathtub drain fitting 34 or the bathtub overflow fitting 14. What is important is that the gasket 28 can be retained on inlet of the bathtub drain fitting 34 or the bathtub overflow fitting 14 to make installation easier as the user does not have to worry about the gasket 28 slipping or moving out of position when working with the drain fitting 34 or the overflow fitting 14. As discussed above, the preferred retaining feature 80 is annular and includes a recessed portion 84 extending from the aperture 116. Also preferred is forming the first sealing portion 114 on the sealing side 78 to have at least the same dimensions as the recessed portion 84, so that the matching retaining feature 82 of the drain or overflow fitting inlet 44, 26 will evenly force the first sealing portion against the bathtub bottom wall 38, or the bathtub end wall 18.

It is contemplated that in some cases the drain opening 36 and overflow opening 16 may be non-circular. In such cases, the first sealing portion 114 will preferably be formed to have substantially the same shape as the bathtub overflow opening 16, however, the outside dimensions of the first sealing portion 114 will be smaller than the outside dimensions of the bathtub overflow opening 16. Similarly, in cases where the bathtub drain 36 opening is non-circular, the aperture 116 will preferably be formed to have substantially the same shape as the bathtub drain opening 36, and the dimensions of the aperture 116 will be substantially the same as the dimensions of the bathtub drain opening 36.

Preferably, the gasket 28 is formed from an elastomeric material, such as rubber, plastic or like material that is flexible with compression and recovery properties so as to be able to form a watertight seal.

Figure 8:
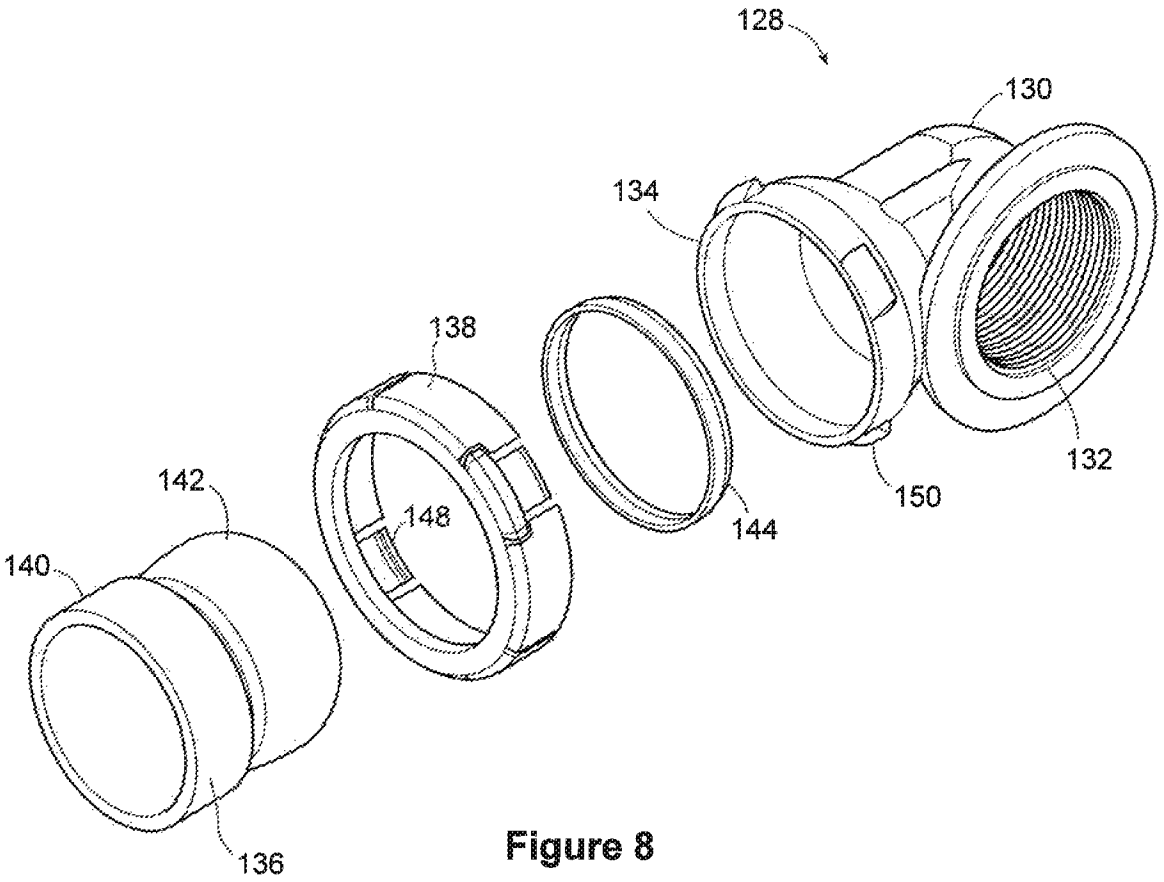
FIG. 8 is an exploded view of a bathtub overflow fitting according to another embodiment of the present invention.
Figure 9:
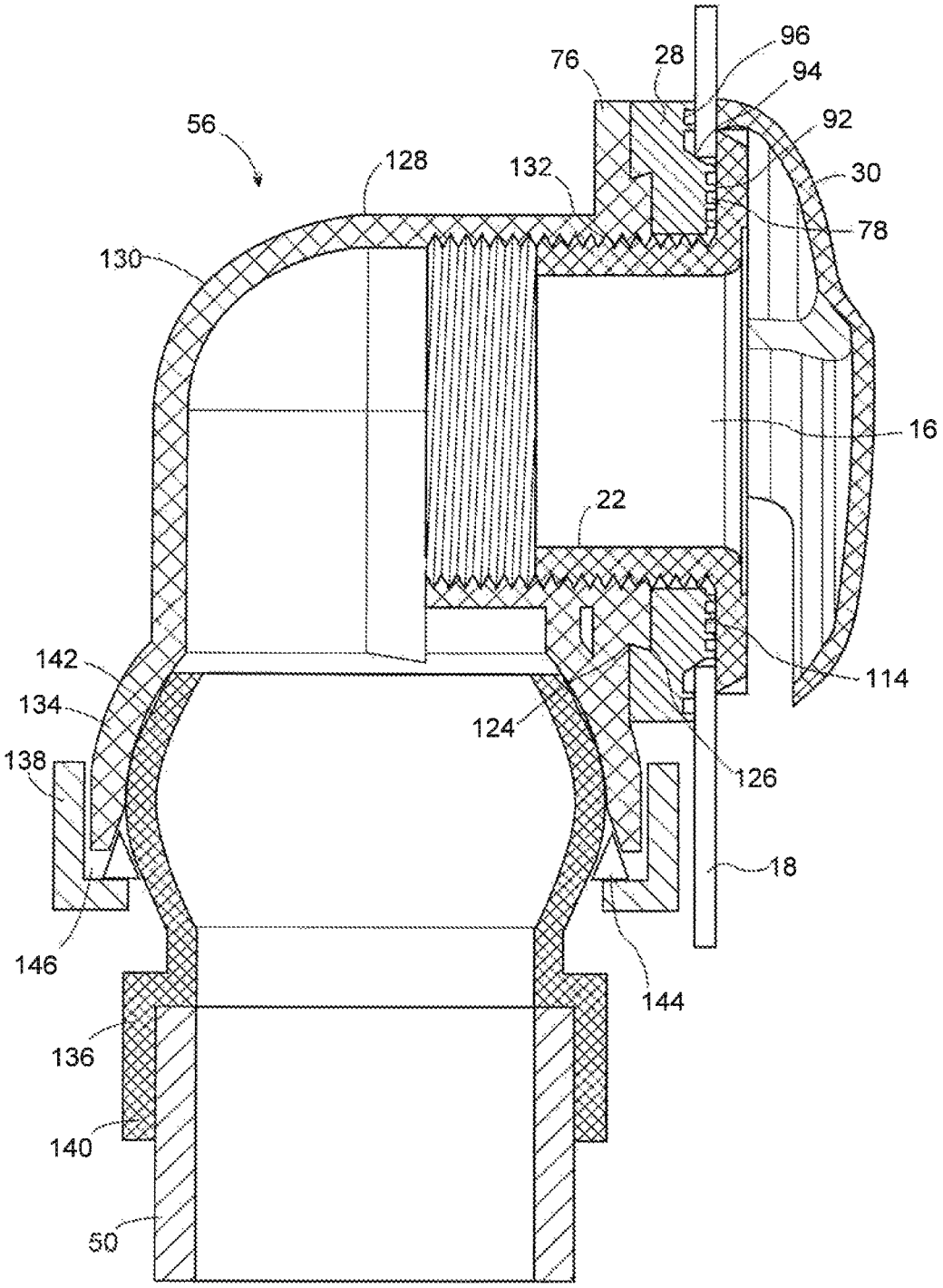
FIG. 9 is a cross-sectional view of the bathtub overflow fitting of FIG. 8 installed at the overflow opening in the bathtub end wall, with the gasket, the faceplate retainer, and the faceplate.

Referring now to FIG. 8, there is shown, in an exploded view, an adjustable bathtub overflow fitting 128 according to another embodiment of the invention. The gasket 28 is not shown in this view. FIG. 9 shows the adjustable bathtub overflow fitting 128 installed at the bathtub overflow opening 16. As can be seen, the adjustable fitting 128 has an inlet body 130 defining an inlet 132 at one end and a joint socket 134 at the other end. The joint socket 134 has a part spherical inner surface. An outlet body 136 is joined to the inlet body 130 with a snap ring 138. The outlet body 136 has an outlet 140 at one end and a joint ball 142 at the other end. The joint ball 142 has a part spherical outer surface that is sized and shaped to mate with the joint socket 134. A seal 144 is positioned in a pocket 146 formed between the snap ring 138, the outer surface of the joint ball 142 and the inner surface of the joint socket 134. The snap ring 138 is configured to permanently join the joint ball 142 and the seal 144 to the joint socket 134 to form a leak resistant joint over a range of angles, with a passageway between the inlet 132 and the outlet 140 of the adjustable drain or overflow fitting 128. Accordingly, the preferred snap ring 138 has one or more locking features 148 configured to interengage with one or more corresponding locking features 150 on the outer surface of the joint socket 134.

Although, the embodiment of the adjustable overflow fitting 128 shown in FIG. 9 has the joint socket 134 on the inlet body 130, and the joint ball 142 on the outlet body 136, it will be appreciated that the invention comprehends the joint socket 134 being on the outlet body 136, and the joint ball 134 being on the inlet body 132.

It will now be appreciated, that although the preferred adjustable overflow fitting 128 has an inlet body 130 with the inlet 132 at a 90° angle relative to its outlet 140, the attachment of the outlet body 140 to the outlet 152 of the inlet body 130 with a ball and socket joint permits a range of angles between the inlet 132 and the outlet 140 of the adjustable drain or overflow fitting 128.

Figure 10:
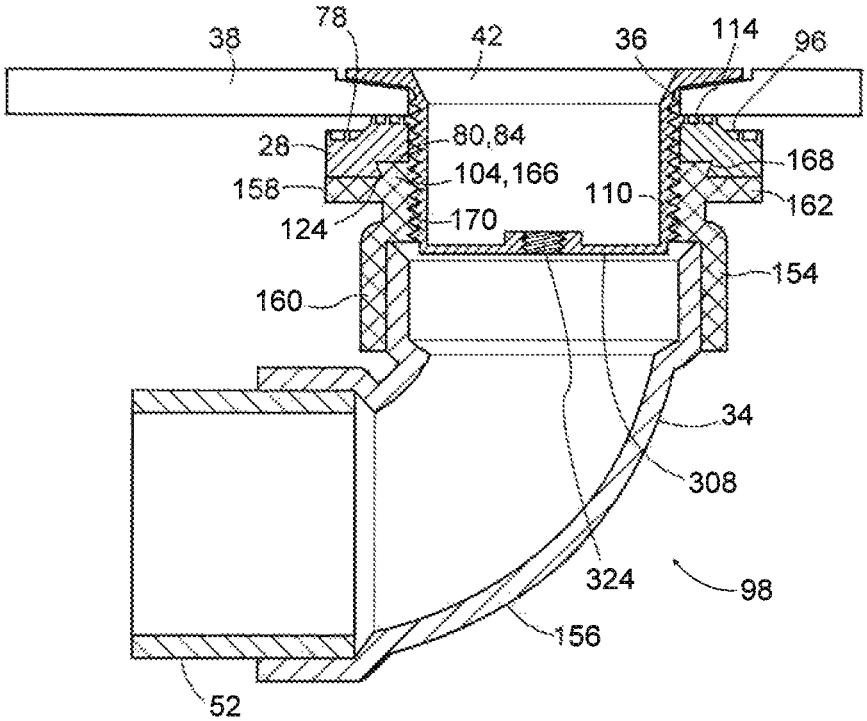
FIG. 10 is a cross-sectional view of the drain portion of the bathtub drain fitting comprising a bathtub adapter fitting according to another embodiment of the present invention installed at the drain opening in the bathtub bottom wall.

Referring now to FIG. 10, there is shown a cross-section of the drain portion 98 of the bathtub drain and overflow kit 10, according to another embodiment of the invention, installed at the drain opening 36 in the bathtub bottom wall 38. As can be seen, the drain fitting 34 is formed from a bathtub adapter fitting 154 connected to a 90° elbow 156. As can be seen, the adapter fitting 154 has an inlet 158 at one end and an outlet 160 at the other end. The outlet 160 of the adapter fitting 154 is attached to the 90° elbow 156, which attaches to conduit 52. As will be appreciated, the outlet 160 of the adaptor fitting 154 may be attached to the 90° elbow 156 by solvent bonding, adhesive bonding or the like. The inlet 158 of the adapter fitting 154 is configure to carry gasket 28 and seal the inlet 158 to the drain opening 36 of the bathtub bottom wall 38. Preferably, the inlet 158 includes a flange 162 sized and shaped to seal the sealing side 78 of gasket 28 around the bathtub drain opening 36. As mentioned above, the gasket 28 preferably can be used at either the drain opening 36 or the overflow opening 16.

As discussed above, the gasket 28 preferably has a retaining feature 80 on the opposite side of the gasket from the sealing side 78. A matching retaining feature 104 is formed on the flange 162, and the retaining feature 80 and the matching retaining feature 104 interengage to retain the gasket 28 on the flange 102. Preferably, the retaining feature 80 is a substantially annular recessed portion 84, and the matching retaining feature 104 is a substantially annular raised portion 166 on the flange 162, and the interengagement is an interference fit coupling or the like, such as for example a snap fitting. For example, the recessed portion 84 may include a continuous or discontinuous overhang 124 for engaging a matching lip or outwardly flared portion 168 of the raised portion 166 as shown in FIG. 10. This configuration makes installation easier as the user does not have to worry about the gasket 28 slipping or moving out of position when working with the adapter fitting 154.

The inlet 158 of the adapter fitting 154 includes a threaded portion 170 which is sized and configured to threadingly accept a faceplate retainer 22 or a drain basket 42. FIG. 10 shows the adapter fitting 154 secured to the drain opening 36 with the drain basket 42, in a similar fashion described above in the context of the drain fitting 34. However, the adapter fitting 154 can just as easily be secured to the overflow opening 16 with the faceplate retainer 22, in a similar fashion described above in the context of the overflow fitting 14.

Referring now to FIGS. 11 to 14, a preferred gasket 228 is shown. The design of gasket 228 is similar to gasket 28 in FIGS. 5 to 7. The gasket 228 is annular in shape for use in circular drain and overflow openings 36, 16. It will be appreciated that the gasket 228 may be formed in other shapes to match the shapes of other drain and overflow openings. The gasket 228 has an aperture 216, a first sealing portion 214, a second sealing portion 296, a tapered sealing portion 294 between the first and second sealing portions, and is configured so that the same gasket 228 can be used at either the drain opening 36 or the overflow opening 16. Preferably, the tapered sealing portion 294 is a concave, rounded edge that integrates with the first sealing portion 214 as shown most clearly in FIG. 15. The rounded edge of the tapered sealing portion 294 allows the tapered sealing portion 294 to account for variations in the shapes and sizes of different overflow openings 16 (FIG. 1) to ensure the gasket 228 provides a waterproof seal.

The second sealing portion 296 extends around the first sealing portion 214 on the sealing side, and is raised relative to the second sealing portion 296. The second sealing portion 296 is sized and positioned to seal against the bathtub end wall 18 (FIG. 1) around the overflow opening 16 to form a secondary seal around the overflow opening 16 (FIG. 1). The tapered sealing portion 294 extends between the first sealing portion 214 and the second sealing portion 296. The tapered sealing portion 294 is sized and positioned to wedge into the overflow opening 16 formed in the bathtub end wall 18 to form a primary seal. Preferably, the tapered sealing portion 294 is configured to allow the gasket 228 to self-centre against the overflow opening 16 (FIG. 1) when the overflow fitting 14 is installed at the overflow opening 16 in the bathtub end wall 18. The rounded edge of the tapered sealing portion 294 assists in allowing the gasket 228 to self-centre against the overflow opening 16 (FIG. 1).

Preferably, the first sealing portion 214 and/or the second sealing portion 296 comprise one or more sealing features 220. The sealing features 220 are resilient ribs or ridges extending from the first and/or second sealing portions 214, 296 to assist in providing a watertight seal. As shown most clearly in FIG. 12, the gasket 228 has two ridges 220 extending from the first sealing portion 214 and two ridges 220 extending from the second sealing portion 296.

Figure 11:
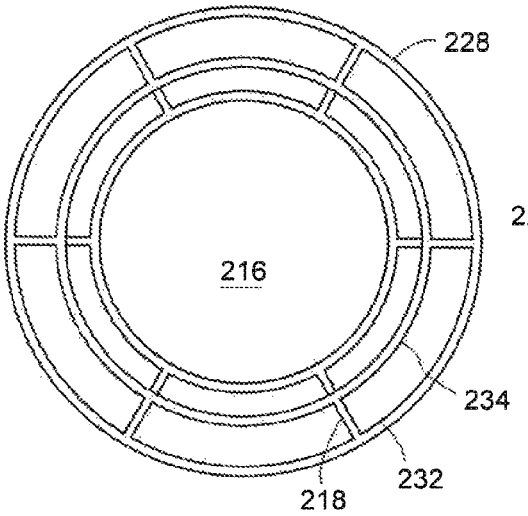
FIG. 11 is a bottom view of an another embodiment of a gasket for a bathtub drain and overflow kit.
Figure 12:
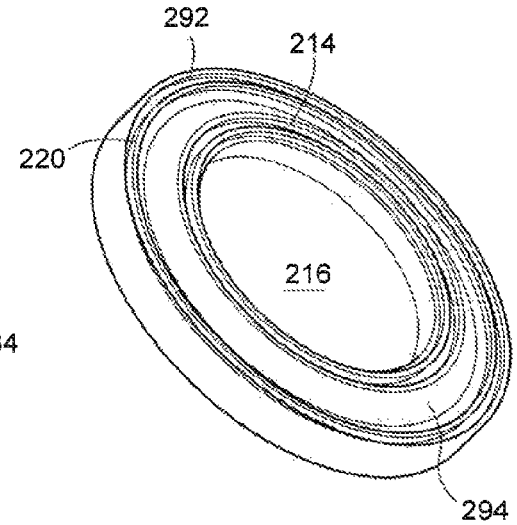
FIG. 12 is a side perspective view of the gasket in FIG. 11.
Figure 13:
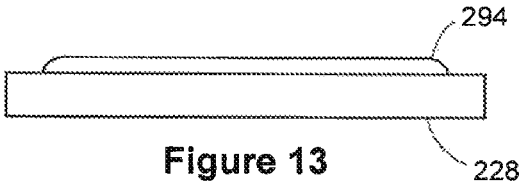
FIG. 13 is a side view of the gasket in FIG. 11.
Figure 14:
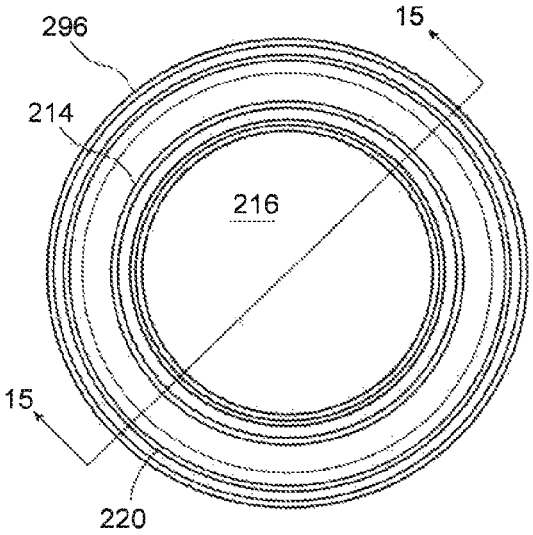
FIG. 14 is a top view of the gasket in FIG. 11.
Figure 15:
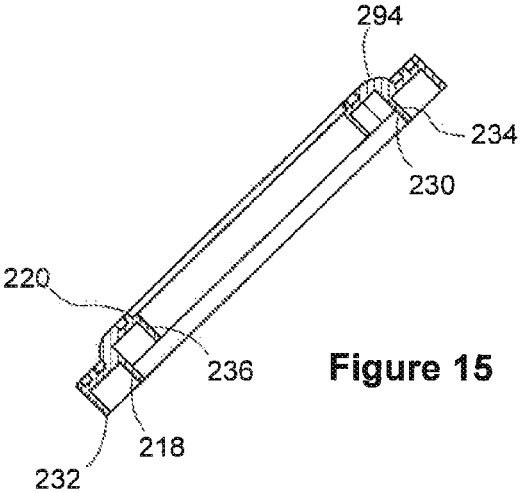
FIG. 15 is a cross-sectional view of the gasket taken along line 15-15 in FIG. 14.
Figure 18:
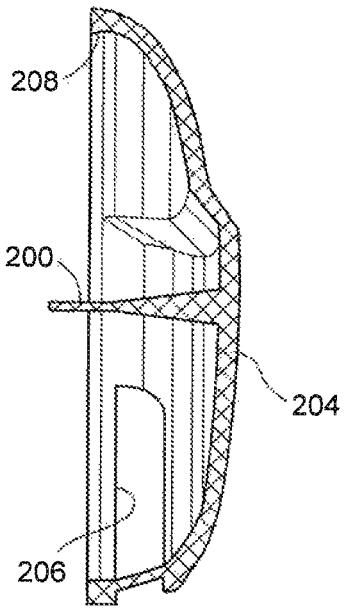
FIG. 18 is a cross-sectional view of the faceplate in FIG. 16 taken along the line 18-18 in FIG. 16.
Figure 16:
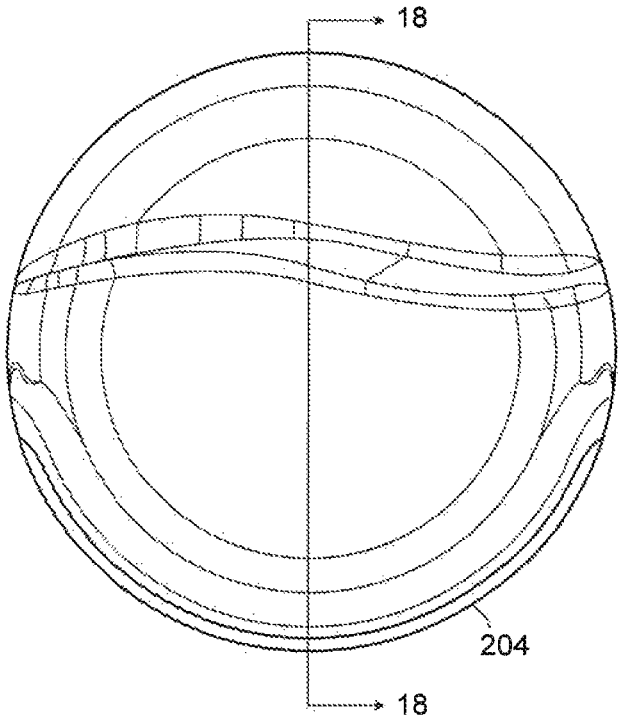
FIG. 16 is a top view of another embodiment of a faceplate for a bathtub drain and overflow fit.
Figure 17:
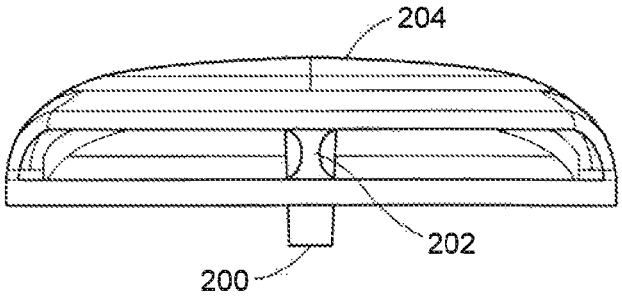
FIG. 17 is a side view of the faceplate in FIG. 16.
Figure 19:
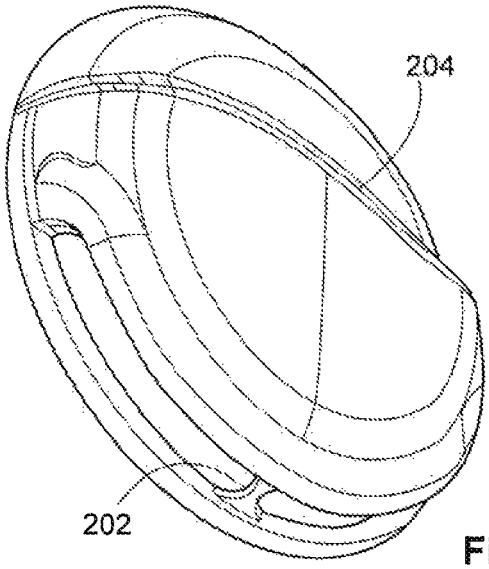
FIG. 19 is a perspective side view of the faceplate in FIG. 16.
Figure 22:
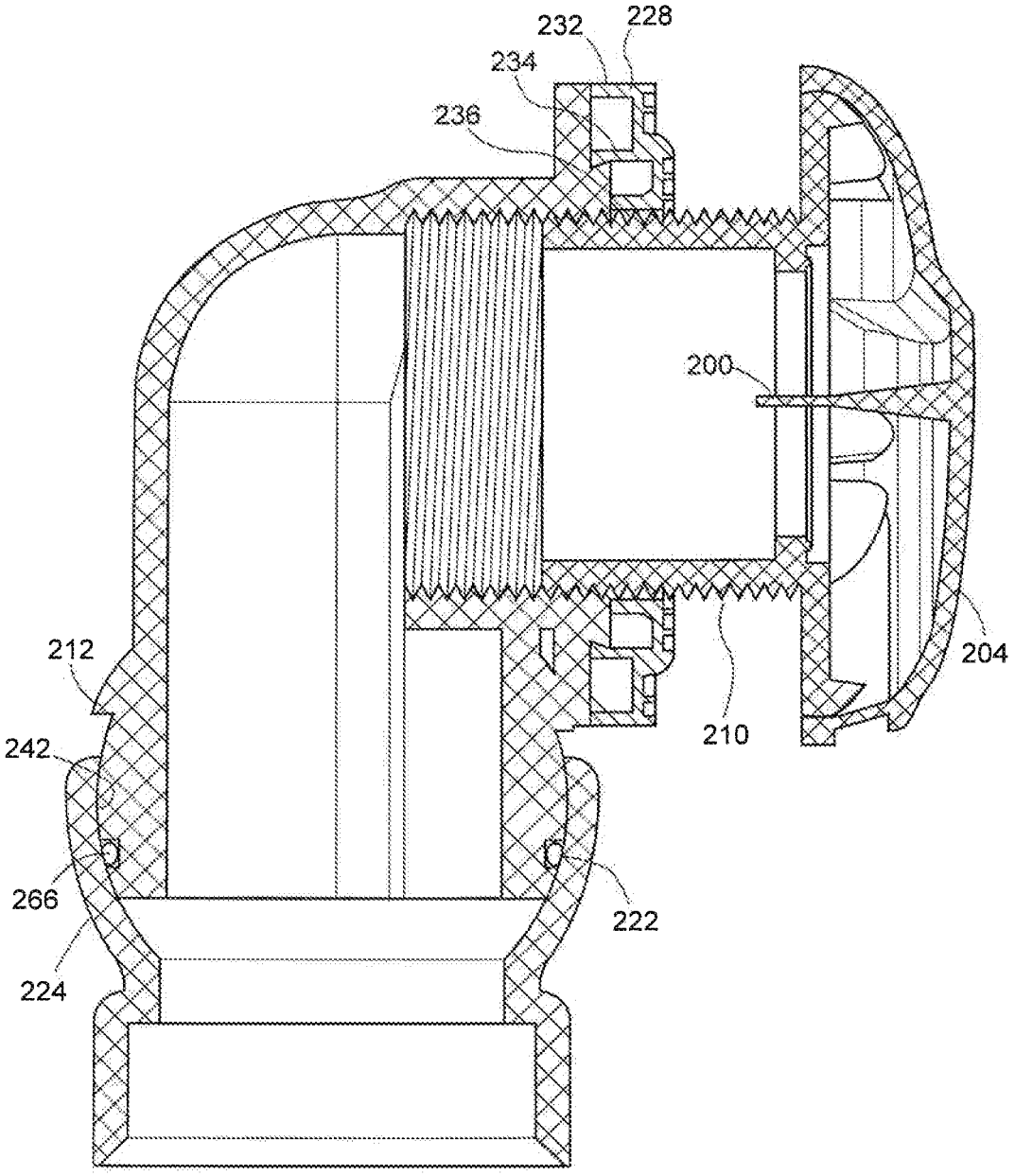
FIG. 22 is cross-sectional view of the assembly of FIG. 21 taken along line 22-22 in FIG. 21.

As best seen in FIGS. 11 and 15, the opposite side of the gasket 228 from the sealing side includes resilient ribs 218 which extend from the base of the gasket 228. The resilient ribs 218 include an exterior ridge 232, a central ridge 234 and an interior ridge 236 which extend from the opposite side of the gasket 228 from the sealing side. As shown in FIG. 15, the exterior ridge 232 and central ridge 234 extend the same distance from the surface of the gasket 228 whereas the interior ridge 236 does not extend to the same distance so that the resilient ribs 232, 234 and 236 can interengage with the matching shape of one of the flange 76, adapter fitting 154 and overflow fitting 226. For example, the interengagement between the ridges 232, 234 and 236 of the gasket 228 against the overflow fitting 226 is shown in FIG. 22. The central ridge 234 has a retaining feature 230 for interengaging the matching retaining feature 82 on the inlet of the bathtub drain fitting 34 or the bathtub overflow fitting 14. What is important is that the gasket 228 can be retained on inlet of the bathtub drain fitting 34 or the bathtub overflow fitting 14 to make installation easier as the user does not have to worry about the gasket 228 slipping or moving out of position when working with the drain fitting 34 or the overflow fitting 14. The retaining feature 230 is an annular notched portion extending from the central ridge 234.

Referring now to FIGS. 16-19, a preferred embodiment of a faceplate 204 is shown. The faceplate 204 snaps onto a faceplate retainer 210 (FIG. 20) and is held in place by a protruding lip 208 along the inner edge of the faceplate perimeter. An opening 206 along the bottom of the faceplate allows effluent to pass from the bathtub 12 (FIG. 1) into the overflow opening 16. A centre rib 202 on the faceplate 204 prevents the faceplate 204 from collapsing under pressure at the bottom of the opening 206. A blunt ended column 200 protrudes from the back of the faceplate 204 as shown best in FIG. 18 to prevent the installation of the faceplate 204 without removal of the test plate or test membrane (not shown) which is placed on the overflow opening 16 during installation. Preferably the column 200 will include ribbing or webbing to provide structural strength to the column 200 to enhance the rigidity and load bearing capacity of the column 200 so that it will be more resistant to breaking or other forms of failure.

Figure 20:
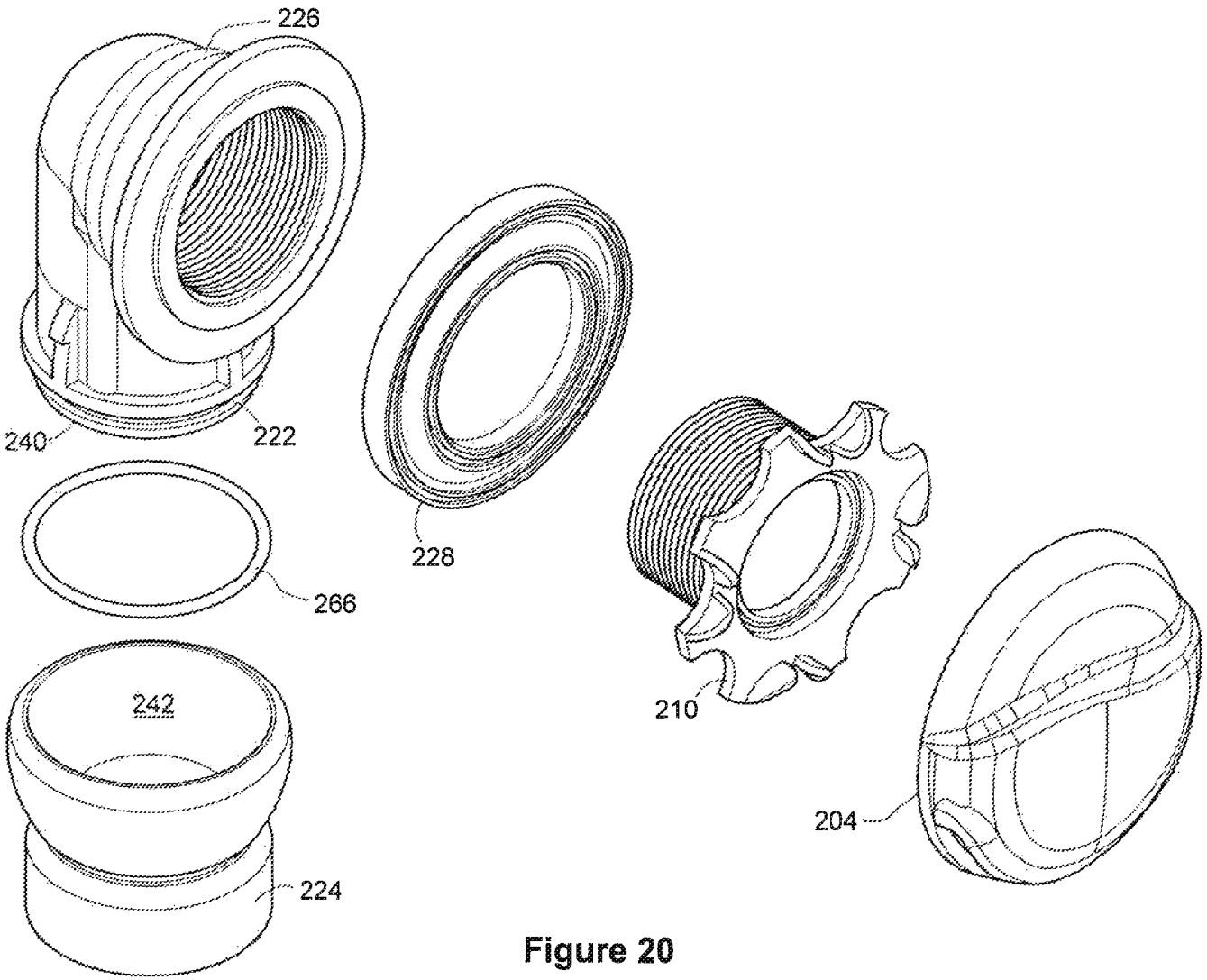
FIG. 20 is an exploded view of another embodiment of a bathtub overflow fitting, a gasket, a faceplate retainer, and a faceplate.
Figure 21:
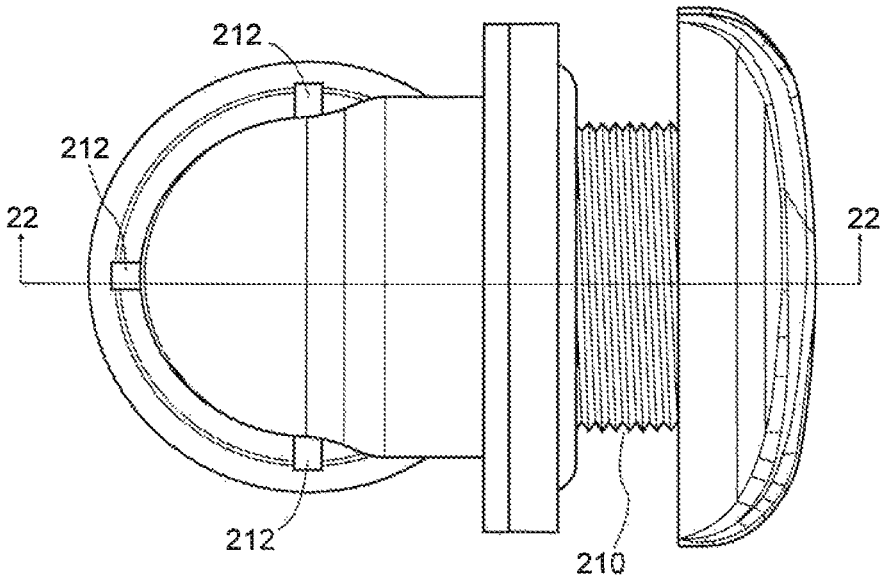
FIG. 21 is an assembled top view of the bathtub overflow fitting, the gasket, the faceplate retainer, and the faceplate of FIG. 20.

Referring now to FIGS. 20 to 22, an embodiment of a bathtub overflow fitting is shown. The faceplate 204 is connected to a faceplate retainer 210 which is threaded onto an overflow fitting 226. The gasket 228 is placed over the face of the overflow fitting 226 and is secured between the overflow fitting 226 and the overflow opening 16 of the bathtub 12 (FIG. 1). The overflow fitting 226 has a connection portion that is a joint ball 240 and the joint ball 240 is connected to an outlet 224 having a connection portion that is a joint socket 242. A seal 266 is positioned between an outer surface of the joint ball 240 and an inner surface of the joint socket 242. A seal retainer 22 lies on the exterior surface of the joint ball 240 to retain the seal between the joint ball 240 and the joint socket 242. In the embodiment shown in FIGS. 20-22, the seal 266 is an o-ring and the seal retainer 222 is a o-ring retainer. The seal retainer 222 is an annular indentation that is recessed into the exterior surface of the joint socket 242. As shown most clearly in FIG. 22, stops 212 protrude from the exterior of the overflow fitting 226 next to the joint ball 240 to prevent angle over adjustment of the joint ball 240 and socket joint 242. Preventing angle over adjustment ensures that the o-ring 266 will not be exposed or dislodged from the o-ring retainer 222. Although four stops 212 are shown in FIG. 21, it will be understood that other numbers of stops and different sizes and configurations of stops may be used as long as angle over adjustment between the joint ball 240 and joint socket 242 can be prevented.

Figure 23:
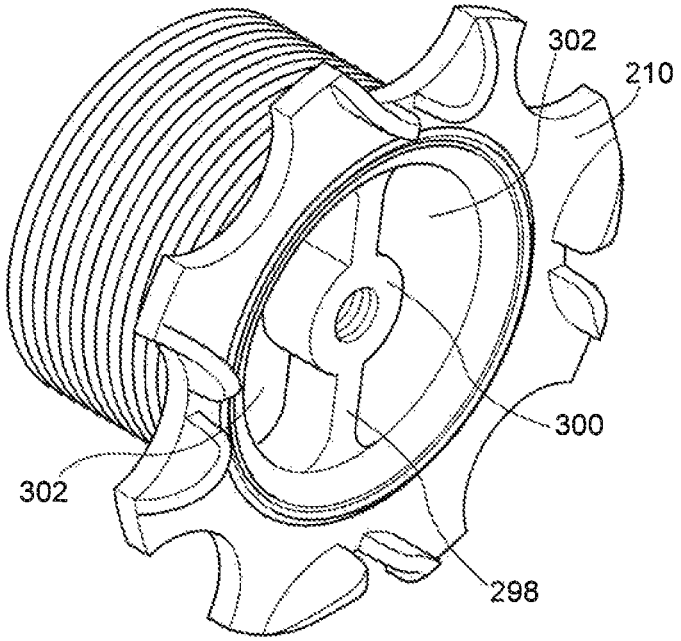
FIG. 23 is a perspective view of a faceplate retainer according to another embodiment of the present invention.

As shown in FIG. 23 the faceplate retainer 210 may be provided with a molded crossbar 298 supporting a threaded centre bore 300 for attaching a single screw thread-on faceplate (not shown). Openings 302 around the crossbar 298 are preferably sized and shaped to permit use of a plumber's snake, or the like to remove clogs formed in downstream pipes.

Figure 24:
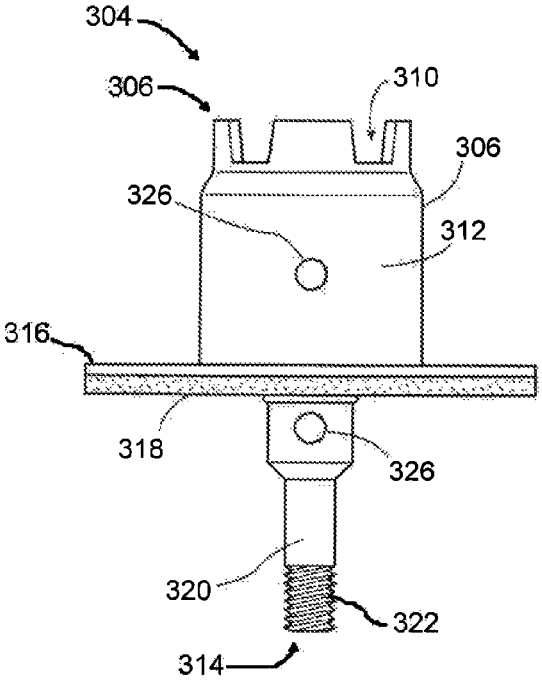
FIG. 24 is a side view of a combination test plug and drain basket wrench tool according to an embodiment of the present invention.
Figure 25:
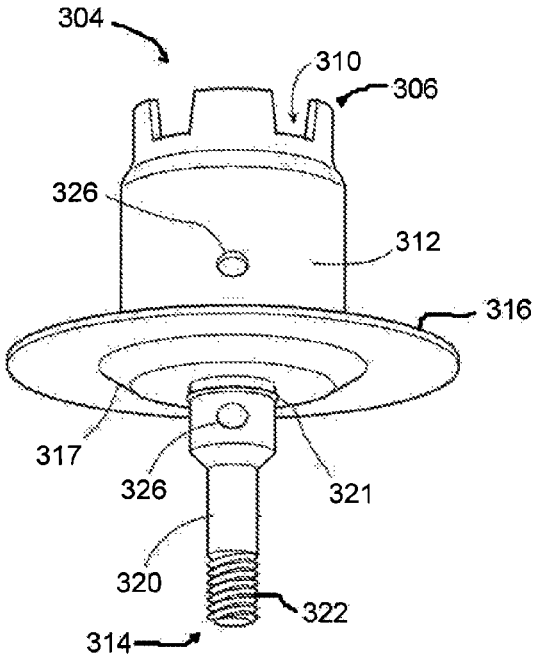
FIG. 25 is a perspective view of the tool of FIG. 24, with the gasket removed.

A combination test plug and drain basket wrench tool 304, shown in FIGS. 24 and 25, according to an embodiment of the present invention, may also be provided with the bathtub drain and overflow kit 10 to facilitate with installation of the drain basket 42 into the drain fitting 34. As shown, the tool 304 has a wrench end 306, which is adapted to function as a drain basket wrench. It is sized and shaped to be inserted into the drain basket 42 and to engage a crossbar 308 inside the drain basket 42, to allow the user to turn the drain basket 42 in one direction to threadingly secure and tighten the drain basket 42 into the drain fitting 34, and compress the gasket 28 to make a watertight seal, without scratching the bathtub bottom wall 38 surrounding the drain opening 26. Of course it is also contemplated that the tool 304 may be used to turn the drain basket 42 in the opposite direction to loosen and remove the drain basket 42 from the drain fitting 34. Accordingly, the wrench end 306 of the tool 304 preferably includes one or more projections or depressions adapted to engage the drain basket 42 crossbar 308 and permit the user to apply a turning force on the drain basket 42 in the drain fitting 34, by rotating the tool 304. By way of example, tool 304 shown in FIGS. 24 and 25 has grooves 310 for fitting over and gripping the crossbar 308. The grooves 310 are tapered to make it easier to fit the tool 304 to the crossbar 308. The grooves 310 are positioned about a cylindrical extension 312 which is sized to reach into the drain basket 42, and bring the grooves 310 into operational contact with the drain basket 42 crossbar 308.

The opposite end 314 of the tool 304, is adapted to function as a test plug. It has a flange 316 sized and shaped to cover the drain basket 42 and compress a rubber gasket 318 against the flanged end 112 of the drain basket 42, to form an air tight seal for hydraulic testing purposes. The flange 316 has a tapered raised portion 317 which is sized and shaped to form an air tight seal in a range drain basket diameters. Extending from the centre of the tapered raised portion 317 is a post 320 with a threaded tip 322. The base of the post 320 has a protruding ridge 321 to hold the gasket 318 in place. The post 320 is sized and shaped to reach into the drain basket 42, and bring the threaded tip 322 into contact with and threadingly engage a matching threaded bore 324, which is supported by the crossbar 308 in the centre of the drain basket 42 (best seen in FIGS. 4 and 10). Turning the tool 304 to tighten the threaded tip 322 of post 320 into the threaded bore 324 will draw the flange 316 against the flanged end 112 of the drain basket 42, covering the drain basket 42 and compressing the rubber gasket 318 therebetween to form an air tight seal.

Preferably, apertures 326 are provided on the extension 312, and the post 320 of the tool 304, into which an elongate lever member, such as a shaft of screw driver, may be inserted and used as a lever to assist the user in applying torque to turn the tool 304.

It will now be appreciated that the tool 304 may be used to secure and tighten the drain basket 42 into the drain fitting 34 when installing the drain portion 98 of the bathtub drain and overflow kit 10 at the drain opening 36 in the bathtub bottom wall 38. Once the installation is complete, the tool 304 may be used to conduct a hydrostatic test of the system, by securing the test plug end 314 to the drain basket 42 to form an air tight seal as discussed above. Once testing is finished, the tool 304 may be removed.

While reference has been made to various preferred embodiments of the invention other variations, implementations, modifications, alterations and embodiments are comprehended by the broad scope of the appended claims. Some of these have been discussed in detail in this specification and others will be apparent to those skilled in the art. Those of ordinary skill in the art having access to the teachings herein will recognize these additional variations, implementations, modifications, alterations and embodiments, all of which are within the scope of the present invention, which invention is limited only by the appended claims.

What is claimed:

1. A bathtub drain and overflow kit comprising an adjustable bathtub fitting and a combination test plug and drain basket wrench tool for installing a drain basket, said drain basket having a crossbar supporting a threaded bore, said adjustable bathtub fitting comprising:

an inlet body defining an inlet at a first end of said inlet body and one of a joint socket having an inner surface and a joint ball having an outer surface at a second end of said inlet body;

an outlet body defining an outlet at a first end of said outlet body and the other of said joint ball and said joint socket at a second end of said outlet body;

a seal member positioned between said outer surface of said joint ball and said inner surface of said joint socket;

a passageway between said inlet and said outlet; and an abutment member extending from said outer surface of said joint ball, and positioned to engage an edge of said joint socket at a predetermined angle of said inlet body relative to said outlet body;

wherein said joint socket has a part spherical inner surface, and said joint ball has a part spherical outer surface that is sized and shaped to mate with said joint socket to form a leak resistant joint between said inlet body and said outlet body over a range of angles; and wherein said abutment member and said edge limit said range of angles; and said tool comprising:

a means for engaging said crossbar of said drain basket and transferring a turning force applied to the tool by a user to the drain basket;

an extension member having a first end and a second end, said first end of said extension member being attached to said engaging means, said extension member being sized and shaped to be inserted into the drain basket and bring said engaging means into operational contact with said crossbar of said drain basket;

a flange attached to said second end of the extension member, said flange being sized and shaped to cover said drain basket;

a post extending from said flange, said post having a threaded tip, and being sized and shaped to be inserted into the drain basket to bring the threaded tip in threaded engagement with the threaded bore supported by the crossbar; and a sealing means positioned about said post adjacent to said flange, said sealing means being sized and shaped to form an air tight seal between said flange and said drain basket, when said threaded tip is tightened into said threaded bore;

wherein said tool is adapted to function as both a drain basket wrench and a test plug.

2. The kit as claimed in claim 1, wherein the seal member is an o-ring.

3. The kit as claimed in claim 1, wherein said joint ball or said joint socket comprises a seal member retaining feature, and said seal member is retained in said seal member retaining feature.

4. The kit as claimed in claim 3, wherein said seal member retaining feature is a groove or recess in said outer surface of said joint ball or said inner surface of said joint socket.

5. The kit as claimed in claim 1, wherein said post or said extension member comprises at least one aperture sized and shaped to accept an elongate lever member to assist the user in turning the tool.

6. The kit as claimed in claim 1, further comprising a gasket retained by said inlet body, said gasket having:

a first sealing portion defining an aperture through a center of said gasket;

a second sealing portion extending axially outward from said aperture around said first sealing portion, said first sealing portion being raised relative to said second sealing portion; and a tapered sealing portion extending between said first sealing portion and said second sealing portion, said tapered sealing portion being sized and positioned on said gasket to contact and wedge into a bathtub overflow opening to form a primary seal.

7. The kit as claimed in claim 1, wherein said first end of said inlet body is sized and shaped to connect to an overflow of a bathtub, a drain of a bathtub, or selectively an overflow of a bathtub and a drain of a bathtub.

8. The kit as claimed in claim 1, wherein said range of angles is 10° or less.

9. The kit as claimed in claim 8, wherein said range of angles is 6° to 7°.

10. The kit as claimed in claim 1, wherein said leak resistant joint is formed by snapping said joint socket over said joint ball.

11. A combination test plug and drain basket wrench tool for installing a drain basket, said drain basket having a cross bar supporting a threaded bore, said tool comprising:

a means for engaging said crossbar of said drain basket and transferring a turning force applied to the tool by a user to the drain basket;

an extension member having a first end and a second end, said first end of said extension member being attached to said engaging means, said extension member being sized and shaped to be inserted into the drain basket and bring said engaging means into operational contact with said crossbar of said drain basket;

a flange attached to said second end of the extension member, said flange being sized and shaped to cover said drain basket;

a post extending from said flange, said post having a threaded tip, and being sized and shaped to be inserted into the drain basket to bring the threaded tip in threaded engagement with the threaded bore supported by the crossbar; and a sealing means positioned about said post adjacent to said flange, said sealing means being sized and shaped to form an air tight seal between said flange and said drain basket when said threaded tip is tightened into said threaded bore, wherein said tool is adapted to function as both a drain basket wrench and a test plug.

* * * * *